US011108152B2

(12) United States Patent
Ito et al.

(10) Patent No.: US 11,108,152 B2
(45) **Date of Patent: *Aug. 31, 2021**

(54) ANTENNA-INTEGRATED WIRELESS MODULE AND METHOD FOR MANUFACTURING ANTENNA-INTEGRATED WIRELESS MODULE

(71) Applicant: Murata Manufacturing Co., Ltd., Kyoto (JP)

(72) Inventors: Yuichi Ito, Kyoto (JP); Taro Hirai, Kyoto (JP); Katsuhiko Fujikawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/730,493

(22) Filed: Dec. 30, 2019

(65) Prior Publication Data

US 2020/0144715 A1 May 7, 2020

Related U.S. Application Data

(63) Continuation of application No. 15/850,818, filed on Dec. 21, 2017, now Pat. No. 10,581,157, which is a (Continued)

(30) Foreign Application Priority Data

Jul. 29, 2013 (JP) ..... 2013-156563
Aug. 22, 2013 (JP) ..... 2013-172392

(51) Int. Cl.
*H01Q 1/52* (2006.01)
*H01Q 23/00* (2006.01)

(Continued)

(52) U.S. Cl.
CPC ..... *H01Q 1/526* (2013.01); *H01Q 1/241* (2013.01); *H01Q 9/0407* (2013.01); *H01Q 23/00* (2013.01)

(58) Field of Classification Search
CPC ..... H01Q 1/526; H01Q 1/241; H01Q 1/52; H01Q 9/0407; H01Q 23/00
See application file for complete search history.

(56) References Cited

U.S. PATENT DOCUMENTS 5,898,909 A 4/1999 Yoshihara
6,693,593 B1 2/2004 Burgess (Continued)

FOREIGN PATENT DOCUMENTS

JP 2002-033419 A 1/2002
JP 2003-032035 A 1/2003

(Continued)

OTHER PUBLICATIONS

International Search Report issued in Application No. PCT/JP2014/062808 dated Aug. 5, 2014.

(Continued)

*Primary Examiner* — Hoang V Nguyen
(74) *Attorney, Agent, or Firm* — Pearne & Gordon LLP

(57) ABSTRACT

An antenna-integrated wireless module comprises a substrate having a first surface and including a wireless region and an antenna region. A wireless functional section is in the wireless region and includes an RF circuit on the first surface or in the substrate. An antenna section is in the antenna region and includes an antenna conductor. A resin sealing layer covers at least a part of the first surface. A thickness of the resin sealing layer in a portion overlapping the antenna region may be thinner than a thickness of the resin sealing layer in a portion overlapping the wireless region such that the resin sealing layer may have a step at a location between (Continued)

the wireless region and the antenna region; or the substrate may have a step at a boundary between the wireless region and the antenna region, and the resin sealing layer may not the cover the step.

20 Claims, 12 Drawing Sheets

Related U.S. Application Data continuation of application No. 15/008,747, filed on Jan. 28, 2016, now Pat. No. 9,887,454, which is a continuation of application No. PCT/JP2014/062808, filed on May 14, 2014, now abandoned.

(51) Int. Cl.
*H01Q 9/04* (2006.01)
*H01Q 1/24* (2006.01)

(56) References Cited

U.S. PATENT DOCUMENTS

| | | | | |
|---|---|---|---|---|
| 7,342,299 | B2 | 3/2008 | Gaucher | |
| 8,451,618 | B2 | 5/2013 | Boeck et al. | |
| 8,874,048 | B2 | 10/2014 | Tsutsumi | |
| 2003/0027532 | A1 | 2/2003 | Ito et al. | |
| 2005/0128155 | A1 | 6/2005 | Fukuda | |
| 2009/0091904 | A1 * | 4/2009 | Hatanaka | H03H 9/1021 361/764 |
| 2011/0309893 | A1 | 12/2011 | Kawamura | |
| 2012/0295668 | A1 | 11/2012 | Kitahara et al. | |
| 2013/0015563 | A1 | 1/2013 | Lee et al. | |
| 2013/0057452 | A1 | 3/2013 | Watanabe | |
| 2013/0222196 | A1 | 8/2013 | Hashimoto | |

FOREIGN PATENT DOCUMENTS

| | | | |
|---|---|---|---|
| JP | 2003-188626 | A | 7/2003 |
| JP | 2003-309423 | A | 10/2003 |
| JP | 2005-236534 | A | 9/2005 |
| JP | 2010-056766 | A | 3/2010 |
| JP | 4466827 | B2 | 5/2010 |
| JP | 3171941 | U | 11/2011 |
| JP | 2012-165329 | A | 8/2012 |
| JP | 2012-243895 | A | 12/2012 |
| JP | 2013-55547 | A | 3/2013 |
| JP | 2013-58513 | A | 3/2013 |
| JP | 2013-179449 | A | 9/2013 |
| WO | 2012/081288 | A1 | 6/2012 |

OTHER PUBLICATIONS

Written Opinion issued in Application No. PCT/JP2014/062808 dated Aug. 5, 2014.
Notice of Reasons for Refusal for JP Application No. 2015-529415, dated Aug. 21, 2018.
Notice of Reasons for Revocation for Japanese Patent No. 6489182, dispatch date Dec. 9, 2019.

* cited by examiner

ANTENNA-INTEGRATED WIRELESS MODULE AND METHOD FOR MANUFACTURING ANTENNA-INTEGRATED WIRELESS MODULE

This is a continuation of U.S. patent application Ser. No. 15/850,818, filed on Dec. 21, 2017, which is a continuation of U.S. patent application Ser. No. 15/008,747, filed on Jan. 28, 2016, which is continuation of International Application No. PCT/JP2014/062808 filed on May 14, 2014 which claims priority from Japanese Patent Application No. 2013-172392 filed on Aug. 22, 2013, and claims priority from Japanese Patent Application No. 2013-156563 filed on Jul. 29, 2013. The contents of these applications are incorporated herein by reference in their entireties.

BACKGROUND OF THE DISCLOSURE

Field of the Disclosure

The present disclosure relates to an antenna-integrated wireless module including a wireless functional section provided with an RF circuit, and an antenna section provided with an antenna conductor, and also relates to a method for manufacturing the antenna-integrated wireless module.

Description of the Related Art

An antenna-integrated wireless module of the type illustrated in FIG. 25 has been proposed so far (see, e.g., Patent Document 1). In an antenna-integrated wireless module 500 illustrated in FIG. 25, a wireless functional section 502 including an RF circuit, which is formed by circuit components such as a base band IC, an RFIC, and a memory IC, is disposed in a region of a substrate 501 spanning from a portion on the one end side to a central portion. Furthermore, a cap-shaped metal case 503 is mounted to an upper surface of the substrate 501 in the region spanning from the portion on the one end side to the central portion in a state covering the surface mounted components that form the RF circuit.

A spiral antenna conductor 504*a* made of a helical line is disposed in a portion of the substrate 501 on the other end side, whereby an antenna section 504 is disposed in the other end side portion of the substrate 501. Moreover, a matching circuit 505 for establishing impedance matching between the wireless functional section 502 and the antenna section 504 is disposed in the other end side portion of the substrate 501. The wireless functional section 502 is connected, through the matching circuit 505, to a feeding point of the antenna conductor 504*a* in the antenna section 504.

Thus, because the wireless functional section 502 and the antenna section 504 are formed adjacent to each other in different regions of the substrate 501, influences upon the antenna section 504 can be suppressed, the influences being caused by the metal case 503 and a ground electrode pattern that is disposed inside the substrate 501 for shielding.

Patent Document 1: Japanese Unexamined Patent Application Publication No. 2003-188626 (Paragraphs 0009 to 0015, FIG. 1, etc.)

BRIEF SUMMARY OF THE DISCLOSURE

In the antenna-integrated wireless module 500 described above, the metal case 503 is needed to suppress influences of electromagnetic waves, which are radiated from the wireless functional section 502, upon external devices, and size reduction of the antenna-integrated wireless module 500 is impeded with the presence of the metal case.

In view of the above-mentioned problem, an object of the present disclosure is to provide an antenna-integrated wireless module that does not need a metal case and that can realize size reduction, and to provide a technique capable of easily manufacturing the module.

To achieve the above object, the present disclosure provides an antenna-integrated wireless module including a substrate that includes a wireless region and an antenna region located at different positions when looking at the substrate in a plan view from a side facing one principal surface thereof, a wireless functional section disposed in the wireless region and including an RF circuit that is disposed at least on the one principal surface of the substrate or inside the substrate, an antenna section disposed in the antenna region and including an antenna conductor that is disposed at least on the one principal surface of the substrate or inside the substrate, a resin sealing layer disposed on the one principal surface of the substrate in a state covering the wireless region and the antenna region at least on a one principal surface side of the substrate, and a shield layer formed on surfaces of the resin sealing layer such that the shield layer does not cover at least a portion of an upper surface of the resin sealing layer, the portion being positioned directly above the antenna region.

According to the present disclosure constituted as described above, on a surface (hereinafter referred to as an "upper surface") of the resin sealing layer on the opposite side away from its surface positioned to face the one principal surface of the substrate, the resin sealing layer being disposed on the one principal surface of the substrate to cover the wireless region and the antenna region at least on the one principal surface side of the substrate, the shield layer is formed in a state not covering a portion of the resin sealing layer, the portion being positioned directly above the antenna region. As a result, electromagnetic waves radiated from the wireless functional section, which is disposed in the wireless region and which includes the RF circuit disposed at least on the one principal surface of the substrate or inside the substrate, can be suppressed by the shield layer formed on the resin sealing layer on the side covering the wireless region. Thus, since metal cases having been used so far are no longer needed, the size of the antenna-integrated wireless module can be reduced.

Since the radiation of the electromagnetic waves from the wireless functional section, which is disposed in the wireless region, can be suppressed by the shield layer without using any expensive metal case, the cost of the antenna-integrated wireless module can be reduced. Moreover, since the shield layer is formed on the upper surface of the resin sealing layer in the state not covering a portion of the resin sealing layer, the portion being positioned directly above the antenna region, it is possible to suppress antenna characteristics of an antenna formed by the antenna conductor from being degraded with the presence of the shield layer that is grounded, and to improve the antenna characteristics in comparison with, for example, the case where the shield layer and the antenna conductor are disposed in regions overlapping each other when looked at in the plan view.

Preferably, the shield layer is formed on the upper surface of the resin sealing layer only in a region overlapping the wireless region when looked at in the plan view.

With the feature described above, on the upper surface of the resin sealing layer disposed on the one principal surface of the substrate to cover the wireless region and the antenna region at least on the one principal surface side of the substrate, the shield layer is formed on the upper surface of the resin sealing layer only in a region overlapping the wireless region when looked at in the plan view. As a result, the electromagnetic waves radiated from the wireless functional section, which is disposed in the wireless region and which includes the RF circuit disposed at least on the one principal surface of the substrate or inside the substrate, can be more reliably suppressed by the shield layer formed on the upper surface of the resin sealing layer on the side covering the wireless region.

Moreover, since the shield layer is formed on the upper surface of the resin sealing layer only in the region on the side covering the wireless region, it is possible to suppress the antenna characteristics of the antenna formed by the antenna conductor from being degraded with the presence of the shield layer that is grounded, and to improve the antenna characteristics in comparison with, for example, the case where the shield layer and the antenna conductor are disposed in regions overlapping each other when looked at in the plan view.

Preferably, a thickness of the resin sealing layer in a portion overlapping the antenna region when looked at in the plan view is thinner than a thickness of the resin sealing layer in a portion overlapping the wireless region when looked at in the plan view, and a level difference step is formed in the resin sealing layer between the wireless region and the antenna region.

With that feature, since the wireless region and the antenna region are located at different positions when looking at the substrate in a plan view from the side facing the one principal surface thereof, and since the thickness of the resin sealing layer on the side covering the antenna region where the antenna section is disposed is relatively thin, the antenna characteristics of the antenna formed by the antenna conductor can be suppressed from being degraded with the presence of the resin sealing layer covering the antenna region. Hence the antenna characteristics of the antenna formed by the antenna conductor can be improved.

The shield layer may be further formed to extend over a lateral surface of the level difference step in the resin sealing layer.

With that feature, since the shield layer is formed to extend over the lateral surface of the level difference step that is formed in the resin sealing layer at the boundary between the wireless region and the antenna region, electromagnetic waves radiated laterally from the wireless functional section disposed in the region overlapping the wireless region when looked at in the plan view can be suppressed from propagating to the antenna section that is positioned adjacent to the wireless functional section. Therefore, a shield effect of the shield layer serving to block off the radiation of the electromagnetic waves from the wireless functional section can be enhanced. It is hence possible to improve isolation characteristics between the wireless functional section, which is disposed in the region overlapping the wireless region when looked at in the plan view, and the antenna section, which is disposed in the region overlapping the antenna region when looked at in the plan view.

A groove may be formed in the resin sealing layer to extend along the lateral surface of the level difference step up to the one principal surface of the substrate or vicinity thereof, and the shield layer may be formed to extend over an inner surface of the groove.

With those features, since the groove is formed in the resin sealing layer to extend along the lateral surface of the level difference step up to the one principal surface of the substrate or the vicinity thereof, and since the shield layer is formed to extend over the inner surface of the groove, the wireless functional section and the antenna section are brought into a state partitioned by the shield layer. Accordingly, adverse influences of the electromagnetic waves radiated from the wireless functional section upon the antenna section can be more effectively suppressed.

The shield layer may be formed to extend over lateral surfaces of the resin sealing layer, the lateral surfaces surrounding the wireless region.

With that feature, since the shield layer is formed to extend over lateral surfaces of the resin sealing layer, the lateral surfaces surrounding the wireless region, the shield effect of the shield layer can be further enhanced in blocking off the radiation of the electromagnetic waves from the wireless functional section that is disposed in the region overlapping the wireless region when looked at in the plan view.

Preferably, a predetermined identification mark is formed in the upper surface of the resin sealing layer in the antenna region.

With that feature, since the predetermined identification mark used to identify the orientation of the module and the type of the module is formed in a region of the upper surface of the resin sealing layer on the side covering the antenna region, the region not including the shield layer formed therein, a surface space of the module can be used effectively. Thus, there is no necessity of additionally securing, on the module, a space in which the predetermined identification mark is to be formed. As a result, the size of the antenna-integrated wireless module can be reduced.

The shield layer may be further formed over at least a part of lateral surfaces of the resin sealing layer, the lateral surfaces surrounding the antenna region.

With that feature, even when, for example, a user's hand approaches the antenna region from the outside around the lateral surfaces thereof, adverse influences upon the antenna characteristics and the antenna directivity can be suppressed to a minimum with the presence of the shield layer. Hence the antenna-integrated wireless module having stable characteristics can be provided.

Preferably, an antenna electrode connected to the antenna section and a signal electrode connected to the wireless functional section are disposed on the other principal surface of the substrate.

With that feature, characteristics of the wireless functional section connected to the signal electrode and a reflection characteristic, etc. of the antenna conductor connected to the antenna electrode can be separately and readily inspected by utilizing the signal electrode and the antenna electrode, which are disposed on the other principal surface of the substrate. Furthermore, the wireless functional section and the antenna section (antenna conductor) can be simply connected to each other by mounting the module to another mounting board such that the signal electrode and the antenna electrode are connected to each other with the aid of a wiring pattern in the other mounting board.

The antenna electrode may include a one-end antenna electrode connected to one end of the antenna conductor, and an opposite-end antenna electrode connected to an opposite end of the antenna conductor.

With that feature, bandpass characteristics of a transfer line formed by the antenna conductor, which have been impossible to evaluate in antennas of related art, can be checked by utilizing the one-end antenna electrode and the opposite-end antenna electrode. Accordingly, manufacturing accuracy of the antenna section can be readily determined on the basis of the measured bandpass characteristics of the antenna conductor.

The antenna region may be disposed plural in the substrate in a sandwiching relation to the wireless region, and the antenna conductor may be disposed in each of the antenna regions at least on the one principal surface of the substrate or inside the substrate.

With that feature, the antenna-integrated wireless module can be provided in a form adaptable for communication with diversity or carrier aggregation by employing a plurality of antennas formed by the antenna conductors that are disposed respectively in the antenna regions at least on the one principal surface of the substrate or inside the substrate, the antenna regions being disposed in the substrate in a sandwiching relation to the wireless region. Moreover, the antenna-integrated wireless module can be provided in a form adaptable for multiband or multimode communication by setting the antennas in correspondence to predetermined communication methods and predetermined frequency bands.

The present disclosure further provides a method for manufacturing an antenna-integrated wireless module, the method including a preparation step of preparing a substrate that includes a wireless region and an antenna region located at different positions when looking at the substrate in a plan view from a side facing one principal surface thereof, a wireless functional section disposed in the wireless region and including an RF circuit that is disposed at least on the one principal surface of the substrate or inside the substrate, and an antenna section disposed in the antenna region and including an antenna conductor that is disposed at least on the one principal surface of the substrate or inside the substrate; a sealing step of applying a resin over the entire one principal surface of the substrate and forming a resin sealing layer in a state entirely covering the one principal surface side of the substrate; a conductive layer forming step of forming a conductor layer, which covers surfaces of the resin sealing layer, with a conductive material; and a removing step of removing a part of the conductive material of the conductive layer formed on an upper surface of the resin sealing layer, the part being present on a side including the antenna region, such that the conductive layer does not cover at least a portion of the upper surface of the resin sealing layer, the portion being positioned directly above the antenna region, whereby a shield layer is formed on the surfaces of the resin sealing layer by the remaining conductive layer.

According to the present disclosure constituted as described above, the conductive layer covering the surface of the resin sealing layer, which is disposed on the one principal surface of the substrate to cover the wireless region and the antenna region at least on the one principal surface side of the substrate, is formed by the conductive material. By removing a part of the conductive material of the conductive layer formed on the upper surface of the resin sealing layer, the part being present on the side including the antenna region, the shield layer is formed by the remaining conductive layer in a state not covering a portion of the resin sealing layer, the portion being positioned directly above the antenna region. Therefore, electromagnetic waves radiated from the wireless functional section, which is disposed in the wireless region and which includes the RF circuit, can be suppressed by the shield layer formed on the resin sealing layer on the side covering the wireless region. As a result, the antenna-integrated wireless module can be readily manufactured which does not need any metal cases having been used so far, and which can realize size reduction of the module.

In the removing step, the shield layer may be formed by the conductive layer on the upper surface of the resin sealing layer only in a region overlapping the wireless region when looked at in the plan view.

With that feature, by removing a part of the conductive material of the conductive layer formed on the upper surface of the resin sealing layer, the part being present on the side including the antenna region, the shield layer is formed by the conductive layer on the upper surface of the resin sealing layer only in the region overlapping the wireless region when looked at in the plan view. Accordingly, the electromagnetic waves radiated from the wireless functional section, which is disposed in the wireless region and which includes the RF circuit, can be more effectively suppressed by the shield layer formed on the upper surface of the resin sealing layer on the side covering the wireless region.

In the removing step, a part of the resin sealing layer on a side covering the antenna region may be removed together with the conductive material such that a thickness of the resin sealing layer on the side covering the antenna region is thinner than a thickness of the resin sealing layer on a side covering the wireless region.

With that feature, since the thickness of the resin sealing layer on the side covering the antenna region where the antenna region is located is relatively thin, the antenna characteristics of the antenna formed by the antenna conductor can be suppressed from being degraded with the presence of the resin sealing layer that covers the antenna region. As a result, the antenna-integrated wireless module can be readily manufactured in which the antenna characteristics of the antenna formed by the antenna conductor are improved.

Preferably, the method for manufacturing the antenna-integrated wireless module further includes, after the sealing step and before the conductive layer forming step, a groove forming step of forming a groove in the resin sealing layer between the wireless region and the antenna region, wherein, in the conductive layer forming step, the conductive layer is further formed over an inner surface of the groove that has been formed in the groove forming step.

With that feature, since a groove is formed in the resin sealing layer between the wireless region and the antenna region in the groove forming step before the conductive layer is formed in the conductive layer forming step, an inner surface of the groove is also covered with the conductive material in the conductive layer forming step, and hence the conductive layer can be readily formed over the inner surface of the groove. Furthermore, with the inner surface of the groove, a lateral surface directed toward the antenna region is defined in the resin sealing layer on the side covering the wireless region. Accordingly, by forming the conductive layer over the inner surface of the groove as well in the conductive layer forming step, the conductive layer can be readily formed in the state extending over a lateral surface of the resin sealing layer on the side covering the wireless region, the lateral surface being directed toward the antenna region. Thus, since the shield layer partitioning the wireless region and the antenna region can be formed, the shield effect of the shield layer can be enhanced, and influences of the electromagnetic waves radiated laterally from the wireless functional section upon the antenna section can be reduced.

The groove may be formed such that a depth of the groove from the upper surface of the resin sealing layer is smaller than a thickness of the resin sealing layer or equal to the thickness of the resin sealing layer. In the latter case, the one principal surface of the substrate is exposed. Alternatively, a recess defining a bottom portion of the groove may be formed in the one principal surface of the substrate such that the depth of the groove is larger than the thickness of the resin sealing layer.

The method for manufacturing the antenna-integrated wireless module may further include, after the removing step, a marking step of forming a predetermined identification mark in the upper surface of the resin sealing layer on the side covering the antenna region.

With that feature, since the predetermined identification mark used to identify the orientation of the module and the type of the module is formed in a region of the upper surface of the resin sealing layer on the side covering the antenna region, the region not including the shield layer formed therein, a surface space of the module can be used effectively. Thus, there is no necessity of additionally securing, on the module, a space in which the predetermined identification mark is to be formed. As a result, the size of the antenna-integrated wireless module can be reduced.

Preferably, an array of the substrates is prepared in the preparation step, and the array of the substrates is divided into individual pieces in units of one substrate after all the steps have been executed.

With that feature, a large number of modules can be manufactured at a time in accordance with a practical manufacturing method using the so-called parent substrate technique.

According to the present invention, the shield layer is formed on the upper surface of the resin sealing layer, which is disposed on the one principal surface of the substrate and covers the wireless functional section and the antenna section at least on the one principal surface side of the substrate such that the shield layer does not cover a portion of the resin sealing layer, the portion being positioned directly above the antenna region. Therefore, electromagnetic waves radiated from the wireless functional section disposed in the wireless region can be suppressed by the shield layer. Since metal cases having been used so far are no longer needed, the size of the antenna-integrated wireless module can be reduced.

DESCRIPTION OF EMBODIMENTS

First Embodiment

Figure 1:
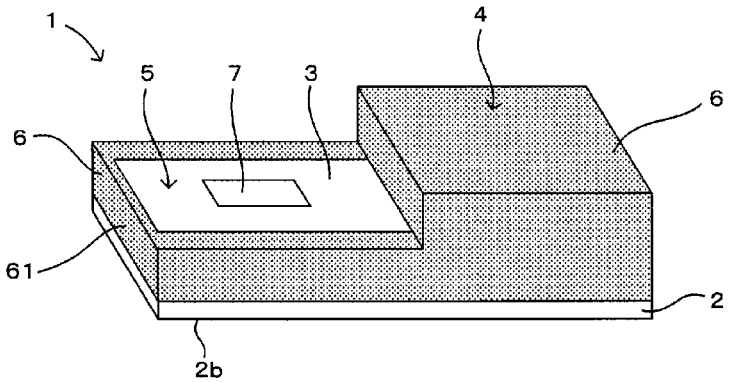
FIG. 1 is a perspective view of an antenna-integrated wireless module according to a first embodiment of the present invention.
Figure 2:
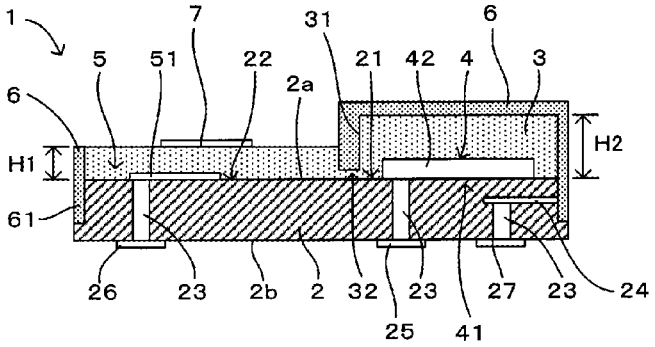
FIG. 2 is a sectional view of the module of FIG. 1.

A first embodiment of the present disclosure will be described below with reference to FIGS. 1 to 3A to 3F. FIG. 1 is a perspective view of an antenna-integrated wireless module according to the first embodiment of the present invention, and FIG. 2 is a sectional view of the module of FIG. 1. FIGS. 3A to 3F illustrate different states in one example of a method for manufacturing the module of FIG. 1. In FIG. 1, for the sake of easier understanding, the shield layer 6 is represented by dotting. In FIGS. 4, 9, 12, 14, 16, 19, and 20 to 22 referenced later, the shield layer 6 (or a conductive layer 61) is similarly represented by dotting, but such a point is not repeated in the following description.

(Antenna-Integrated Wireless Module)

The antenna-integrated wireless module 1 (hereinafter simply called as the "module") is mounted to a mounting board equipped in a communication portable terminal (not illustrated), e.g., a cellular phone, a smart phone, or a tablet. The antenna-integrated wireless module 1 is mounted, for example, to a communication portable terminal that includes a plurality of communication systems executing communications in accordance with the different communication standards, such as GSM (registered trademark) standards, W-CDMA standards, LTE standards, Bluetooth (registered trademark) standards, and a plurality of communication systems executing communications in different bands (frequency bands) in accordance with the same communication standards, and that is adaptable for multi-mode and multiband communications executed in accordance with the plurality of communication standards by utilizing the plurality of frequency bands.

As illustrated in FIGS. 1 and 2, the module 1 includes a substrate 2 including a wireless region 21 and an antenna region 22, and a resin sealing layer 3 that is disposed on one principal surface 2*a* of the substrate 2, and that covers the wireless region 21 and the antenna region 22. The resin sealing layer 3 is formed by applying (pouring) a general thermosetting resin adapted for molding, such as an epoxy resin or a cyanate resin, over the one principal surface 2*a* of the substrate 2 such that the applied resin covers the wireless region 21 and the antenna region 22.

A wireless functional section 4 including an RF circuit 41 is disposed in a region overlapping the wireless region 21 of the substrate 2 when looking at the module in a plan view. The RF circuit 41 is formed as a combination of various circuits (not illustrated), etc., which are disposed in the region overlapping the wireless region 21 of the substrate 2 when looked at in the plan view, and which are formed by electronic components 42 such as an RF IC, a switch IC, and filter elements, various chip-type passive elements (not illustrated) such as resistors, inductors, and capacitors, and electrode patterns inside the substrate 2.

The various electronic components 42 and the various chip-type passive elements, which are included in the RF circuit 41, may be mounted at least on the one principal surface 2*a* of the substrate 2 or inside the substrate 2.

An antenna section 5 including an antenna conductor 51 is disposed in a region overlapping the antenna region 22 of the substrate 2 when looked at in the plan view. The antenna conductor 51 has a shape corresponding to a frequency band used in communication, and it is formed in the antenna region 22 of the one principal surface 2*a* of the substrate 2 by employing a metal material. The antenna conductor 51 included in the antenna section 5 is not limited to the above-mentioned example. The antenna section 5 may include, as another example, an antenna conductor formed by a wiring pattern that is disposed inside the substrate 2. Alternatively, the antenna section 5 may include the so-called chip antenna as the antenna conductor. It is to be noted that the wireless region 21 and the antenna region 22 are located at different positions when looking at the substrate 2 in a plan view from the side facing the one principal surface 2*a*.

The resin sealing layer 3 covers the wireless functional section 4 (including the electronic components 42) that is disposed on the one principal surface 2*a* of the substrate 2 in the wireless region 21, and the antenna section 5 (including the antenna conductor 51) that is disposed on the one principal surface 2*a* of the substrate 2 in the antenna region 22. A groove 31 is formed in the resin sealing layer 3 along a boundary between the wireless region 21 and the antenna region 22. Moreover, a thickness H1 of the resin sealing layer 3 in the region overlapping the antenna region 22 is set to be thinner than a thickness H2 of the resin sealing layer 3 in the region overlapping the wireless region 21, whereby a level difference step 32 is formed in the resin sealing layer 3 between the wireless region 21 and the antenna region 22.

The shield layer 6 is formed, on a surface (upper surface) of the resin sealing layer 3 on the opposite side away from its surface positioned to face the one principal surface 2*a* of the substrate 2, only in the region overlapping the wireless region 21 when looked at in the plan view. Furthermore, in this embodiment, the shield layer 6 is formed to extend over not only outer lateral surfaces of the resin sealing layer 3, which surround an outer periphery of the wireless region 21, but also over a lateral surface of a portion of the resin sealing layer 3, the portion defining the level difference step 32, and over an inner surface of the groove 31 that is formed along the lateral surface of the level difference step 32 toward the one principal surface 2*a* of the substrate 2. Thus, the shield layer 6 is formed to extend over the lateral surfaces of the resin sealing layer 3, which surround the wireless region 21, and hence over all the surfaces of the resin sealing layer 3 on the side covering the wireless region 21.

Moreover, in this embodiment, as illustrated in FIGS. 1 and 2, since the shield layer 6 is formed to extend over the lateral surface of a portion of the resin sealing layer 3, the portion defining the level difference step 32, and over the inner surface of the groove 31 that is formed toward the one principal surface 2*a* of the substrate 2, the shield layer 6 is further formed over lateral surfaces of the resin sealing layer 3, which surround the antenna region 22.

The shield layer 6 is formed by coating a general conductive paste (conductive material) containing, e.g., Ag or Cu, over the surfaces of the resin sealing layer 3.

A predetermined identification mark 7 is formed in a region of the upper surface of the resin sealing layer 3, the region overlapping the antenna region 22 when looked at in the plan view. The identification mark 7 is used to identify the orientation of the module 1 and the type of the module 1. The identification mark 7 is formed by a general method such as silk printing or laser printing.

In this embodiment, the substrate 2 is formed of a multilayer ceramic substrate that is fabricated by laminating a plurality of ceramic green sheets, and firing the laminated sheets. The ceramic green sheets are each obtained by processing, into the form of a sheet, slurry in which mixed power of, e.g., alumina and glass, is mixed with an organic binder, a solvent, etc. Via conductors 23 for interlayer connection are formed through the steps of forming via holes in the ceramic green sheet at predetermined positions with, e.g., laser processing, and filling a conductive paste containing, e.g., Ag or Cu into the formed via holes. The various electrode patterns 24 are further formed on the ceramic green sheet at predetermined positions by printing the conductive paste. Thereafter, the individual ceramic green sheets are laminated and press-bonded together, whereby a ceramic laminate is formed. The substrate 2 is then obtained through the so-called low temperature firing, i.e., by firing the ceramic laminate at low temperature of about 1000° C.

Inside the substrate 2 constituted as described above, inner wiring patterns are formed by the via conductors 23 and the electrode patterns 24. Moreover, on the one principal surface 2*a* of the substrate 2, there are formed mount electrodes (not illustrated) to which the electronic components 42, the various chip-type passive elements constituting the matching circuit, etc. are mounted. On the other principal surface 2*b* of the substrate 2, there are formed, as electrodes for connection of the module 1 to the outside, a signal electrode 25 connected to the wireless functional section 4 through the inner wiring pattern, an antenna electrode 26 connected to the antenna conductor 51 (antenna section 5) through the inner wiring pattern, and a ground electrode 27 connected to the shield layer 6 through the inner wiring pattern.

The shield layer 6 is electrically connected to an end surface of the electrode pattern 24, which is exposed at an outer lateral surface of the substrate 2, and is further connected to the ground electrode 27 through the via conductor 23. The antenna electrode 26 is connected to the feeding point of the antenna conductor 51 through the via conductor 23. The matching circuit (not illustrated) is also connected to the feeding point of the antenna conductor 51.

The substrate 2 may be formed of, e.g., a printed substrate made of a resin or polymer material, an alumina-based substrate, a glass substrate, a composite material substrate, a single-layer substrate, or a multilayer substrate. The substrate 2 may be formed by optionally selecting an optimum material depending on the purpose of use of the module 1.

The module 1 constituted as described above is mounted to an external mounting board, whereupon the signal electrode 25 and the antenna electrode 26 are electrically connected to each other through a wiring pattern disposed on the external mounting board such that wireless signals are input and output between the wireless functional section 4 and the antenna section 5.

(Manufacturing Method)

Successive steps of a method for manufacturing the antenna-integrated wireless module 1 will be described below.

In this embodiment, the module 1 is manufactured by forming an array of the plural modules 1, and then dividing the array into the individual modules.

Figure 3A:
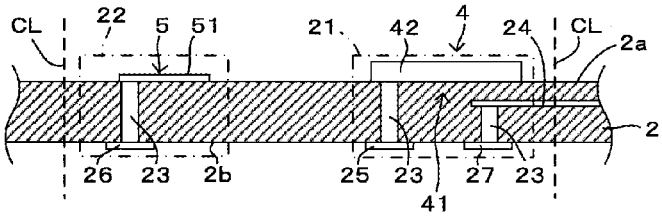
FIGS. 3A to 3F illustrate different states in one example of a method for manufacturing the module of FIG. 1.

First, as illustrated in FIG. 3A, the array of the substrates 2, each including the via conductors 23 and the electrode patterns 24 disposed at the predetermined positions, is prepared (preparation step). The array of the substrates 2 includes, in its entire one principal surface 2*a*, a plurality of regions where the modules 1 are to be formed. Each of the module formation regions includes the wireless region 21 and the antenna region 22. The wireless functional section 4 including the RF circuit 41 (electronic components 42), which is disposed at least on the one principal surface 2*a* of the substrate 2 or inside the substrate 2, is disposed in each region overlapping the wireless region 21 of the substrate 2 when looked at in the plan view. The antenna section 5 including the antenna conductor 51, which is disposed at least on the one principal surface 2*a* of the substrate 2 or inside the substrate 2, is disposed in each region overlapping the antenna region 22 of the substrate 2 when looked at in the plan view. A cut line CL denoted by a broken line in the drawings represent a cut position in the array of the substrates 2 when the array of the plural modules 1 is divided into the individual modules.

Figure 3B:
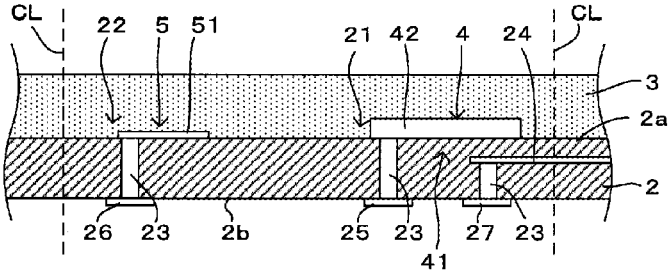

Next, as illustrated in FIG. 3B, the resin sealing layer 3 is formed by applying (pouring) a thermosetting resin adapted for molding over the entire one principal surface 2*a* of the array of the substrates 2 so as to cover the wireless region 21 and the antenna region 22, including the wireless functional section 4 disposed in the wireless region 21 and the antenna section 5 disposed in the antenna region 22 (sealing step).

Figure 3C:
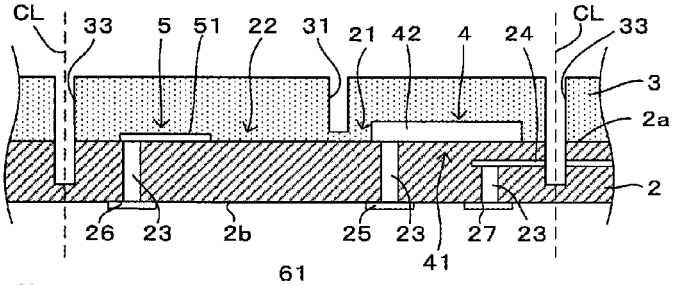

Next, as illustrated in FIG. 3C, grooves 31 and 33 are formed in the resin sealing layer 3 by employing a general device, e.g., a dicer (groove forming step). More specifically, the groove 31 having a depth from an upper surface of the resin sealing layer 3, the depth being smaller than a thickness of the resin sealing layer 3, is formed along the boundary between the wireless region 21 and the antenna region 22. Moreover, the groove 33 having a depth from the upper surface of the resin sealing layer 3, the depth being larger than the thickness of the resin sealing layer 3, is formed at a position of each cut line CL.

Because the groove 33 is formed by cutting not only the resin sealing layer 3, but also the substrate 2, the electrode pattern 24 formed inside the substrate 2 at the position of the cut line CL is also cut, and a cut surface of the substrate is exposed to an inner space of the groove 33. The groove 31 may be formed such that the depth of the groove 31 from the upper surface of the resin sealing layer 3 is equal to the thickness of the resin sealing layer 3. In such a case, the one principal surface 2*a* of the substrate 2 is exposed to an inner space of the groove 31. Alternatively, the groove 31 may be formed, as in the case of the groove 33, such that its depth from the upper surface of the resin sealing layer 3 is larger than the thickness of the resin sealing layer 3.

Figure 3D:
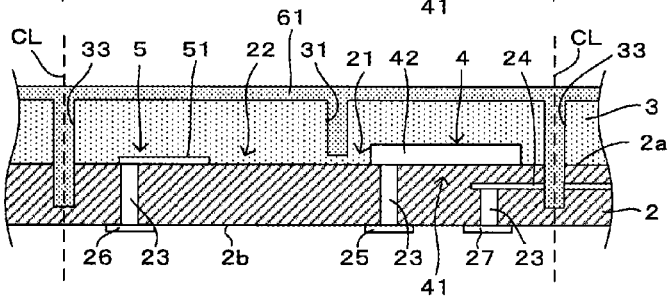
Figure 3E:
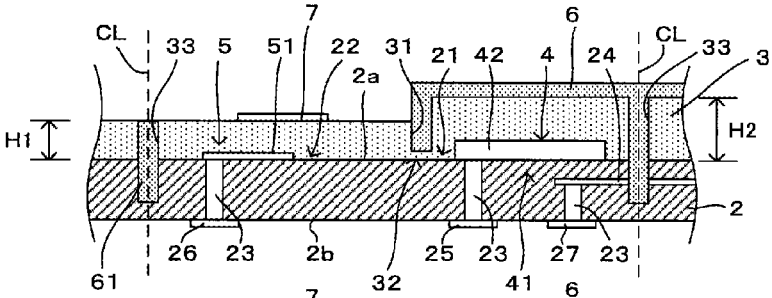

Then, as illustrated in FIG. 3D, a conductive layer 61 covering surfaces of the resin sealing layer 3 is formed by coating a general conductive paste (conductive material) containing, e.g., Ag or Cu over the surfaces of the resin sealing layer 3 while filling the conductive paste into the grooves 31 and 33 (conductive layer forming step). Next, as illustrated in FIG. 3E, the conductive material in a region of the conductive layer 61 formed on the upper surface of the resin sealing layer 3, the region overlapping the antenna region 22 when looked at in the plan view, is removed with a dicer, a Leutor, or laser processing (removing step). As a result, the shield layer 6 is formed by the conductive layer 61 on the upper surface of the resin sealing layer 3 only in the region overlapping the wireless region 21 when looked at in the plan view.

Moreover, in the removing step, a part of the resin sealing layer 3 in the region overlapping the antenna region 22 is removed together with the conductive material such that the thickness H1 of the resin sealing layer 3 in the region overlapping the antenna region 22 is thinner than the thickness H2 of the resin sealing layer 3 in the region overlapping the wireless region 21. Accordingly, the level difference step 32 is formed in the resin sealing layer 3 at the boundary between the wireless region 21 and the antenna region 22. After the removing step, the predetermined identification mark 7 used to identify the orientation of the module 1 and the type of the module 1 is formed by a general method, such as silk printing or laser printing, in a region of the upper surface of the resin sealing layer 3, the region overlapping the antenna region 22 when looked at in the plan view (marking step).

Figure 3F:
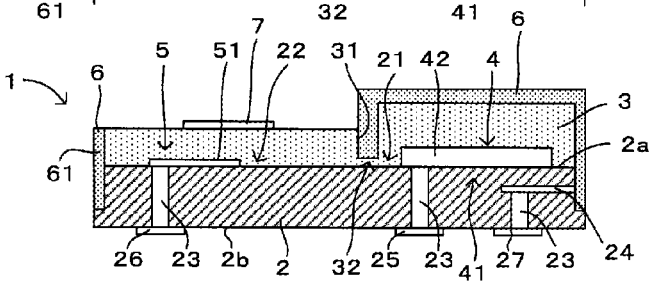

Finally, as illustrated in FIG. 3F, the array of the substrates 2 is divided along the cut lines CL into the individual substrates, whereby the modules 1 are completed.

According to this embodiment, as described above, on the upper surface of the resin sealing layer 3 formed on the one principal surface 2*a* of the substrate 2 to cover the electronic components 42 disposed in the wireless region 21 and the antenna conductor 51 disposed in the antenna region 22, the shield layer 6 is formed only in the region overlapping the wireless region 21 when looked at in the plan view. Therefore, the shield layer 6 formed on the upper surface of the resin sealing layer 3 on the side covering the wireless region 21 can serve to suppress electromagnetic waves radiated from the wireless functional section 4, which is disposed in the region overlapping the wireless region 21 when looked at in the plan view, and which includes the RF circuit 41 disposed at least on the one principal surface 2*a* of the substrate 2 or inside the substrate 2. In addition, the shield layer 6 can protect the RF circuit 41 of the wireless functional section 4 from external electromagnetic noise. Thus, since metal cases having been used so far are no longer needed, the size of the module 1 can be reduced.

Since the radiation of the electromagnetic waves from the wireless functional section 4, which is disposed in the region overlapping the wireless region 21 when looked at in the plan view, can be suppressed by the shield layer 6 without using any expensive metal case, the cost of the module 1 can be reduced. Moreover, the shield layer 6 is formed on the upper surface of the resin sealing layer 3 only in the region overlapping the wireless region 21 when looked at in the plan view. Accordingly, antenna characteristics of an antenna formed by the antenna conductor 51 can be suppressed from being degraded with the presence of the shield layer 6 that is grounded, and the antenna characteristics can be improved in comparison with, for example, the case where the shield layer 6 and the antenna conductor 51 are disposed at positions overlapping each other when looked at in the plan view.

The resin sealing layer 3 on the side overlapping the antenna region 22 where the antenna section 5 is disposed is formed to be relatively thin. Therefore, the antenna characteristics of the antenna formed by the antenna conductor 51 can be suppressed from being degraded with the presence of the resin sealing layer 3 covering the antenna region 22. As a result, the antenna characteristics of the antenna formed by the antenna conductor 51 can be improved.

The shield layer 6 is formed to extend into the groove 31 that is formed in the resin sealing layer 3 at the boundary between the wireless region 21 and the antenna region 22. This enhances the shield effect of the shield layer 6 serving to block off the radiation from the wireless functional section 4 that is disposed in the region overlapping the wireless region 21 when looked at in the plan view. It is hence possible to improve isolation characteristics between the wireless functional section 4, which is disposed in the region overlapping the wireless region 21 when looked at in the plan view, and the antenna section 5, which is disposed in the region overlapping the antenna region 22 when looked at in the plan view.

According to the embodiment described above, since the shield layer 6 is formed to extend over all the lateral surfaces of the resin sealing layer 3 surrounding the wireless region 21, the shield effect of the shield layer serving to block off the radiation from the wireless functional section 4, which is disposed in the region overlapping the wireless region 21 when looked at in the plan view, can be further enhanced.

The predetermined identification mark 7 used to identify the orientation of the module 1 and the type of the module 1 is formed in a region of the upper surface of the resin sealing layer 3, the region overlapping the antenna region 22 when looked at in the plan view and not including the shield layer 6 formed therein. Thus, a surface space of the module 1 can be used effectively. In other words, since there is no necessity of additionally securing, on the module 1, a space in which the predetermined identification mark 7 is to be formed, the size of the module 1 can be reduced.

According to the above-described method for manufacturing the module 1, the conductive layer 61 covering the surfaces of the resin sealing layer 3, which is formed on the one principal surface 2*a* of the substrate 2 to cover the wireless region 21 and the antenna region 22, is made of the conductive material. By removing the conductive material in a region of the conductive layer 61 formed on the upper surface of the resin sealing layer 3, the region overlapping the antenna region 22 when looked at in the plan view, the shield layer 6 is formed by the conductive layer 61 on the upper surface of the resin sealing layer 3 only in the region overlapping the wireless region 21 when looked at in the plan view. Thus, the shield layer 6 formed on the upper surface of the resin sealing layer 3 on the side covering the wireless region 21 can serve to suppress electromagnetic waves radiated from the wireless functional section 4, which is disposed in the region overlapping the wireless region 21 when looked at in the plan view, and which includes the RF circuit 41. As a result, the antenna-integrated wireless module 1 can be easily manufactured which does no longer need metal cases having been used so far, and which can realize size reduction.

Since, in the removing step, the resin sealing layer 3 covering the antenna region 22 where the antenna section 5 is disposed is formed to be relatively thin, the antenna characteristics of the antenna formed by the antenna conductor 51 can be suppressed from being degraded with the presence of the resin sealing layer 3 covering the antenna region 22. Thus, the antenna-integrated wireless module 1 can be easily manufactured which can improve the antenna characteristics of the antenna formed by the antenna conductor 51.

Since, in the groove forming step, the groove 31 is formed in the resin sealing layer 3 along the boundary between the wireless region 21 and the antenna region 22, the lateral surface directed toward the antenna region is defined by the inner surface of the groove 31 in the resin sealing layer 3 on the side covering the wireless region 21. Accordingly, by forming the conductive layer 61 over the inner surface of the groove 31 in the conductive layer forming step, the shield layer 6 can be easily formed to extend over a lateral surface of the resin sealing layer 3 on the side covering the wireless region 21, the lateral surface facing the antenna region 22.

Since, in the marking step, the predetermined identification mark 7 used to identify the orientation of the module 1 and the type of the module 1 is formed in a region of the upper surface of the resin sealing layer 3, the region overlapping the antenna region 22 when looked at in the plan view and not including the shield layer 6 formed therein, the surface space of the module 1 can be used effectively.

Figure 25:
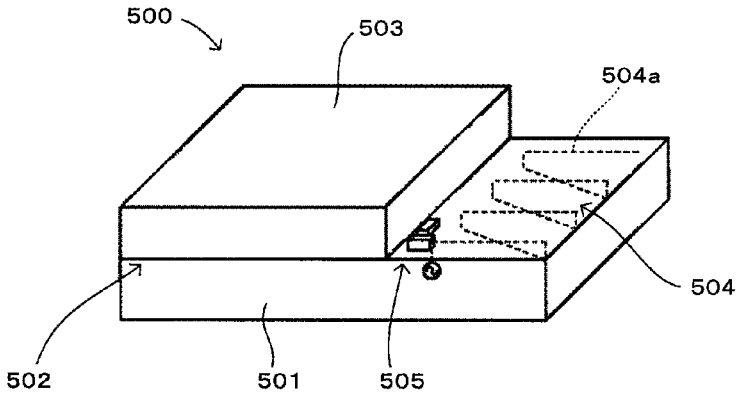
FIG. 25 illustrates an antenna-integrated wireless module of related art.

In the related-art antenna-integrated wireless module 500 illustrated in FIG. 25, a high-frequency signal connector needs to be coupled to a high-frequency transfer path, which interconnects the wireless functional section 502 and the antenna section 504, in order to evaluate quality of the antenna section 504. If the resin sealing layer is disposed on the substrate 501, the high-frequency signal connector cannot be coupled to the high-frequency transfer path.

Furthermore, a connector including a switch needs to be used in order to separately evaluate respective characteristics of the wireless functional section 502 and the antenna section 504 by employing the high-frequency signal connector coupled to the high-frequency path. In other words, it is required to separate the wireless functional section 502 and the antenna section 504 independently of each other by cutting the high-frequency transfer path, which interconnects the wireless functional section 502 and the antenna section 504, with the switch.

In contrast, according to the embodiment described above, characteristics of the wireless functional section 4 connected to the signal electrode 25 and characteristics of the antenna conductor 51 (antenna section 5) connected to the antenna electrode 26 can be readily separated and individually checked in an independent manner at the time of product shipment, for example, by employing the signal electrode 25 and the antenna electrode 26 both disposed on the other principal surface 2*b* of the substrate 2. As a result, at the time of product shipment, characteristics of only the wireless functional section 4 can be independently evaluated by separating the antenna section 5 that usually has large variations in characteristics.

Moreover, the wireless functional section 4 and the antenna section 5 (antenna conductor 51) can be simply connected to each other by mounting the module 1 to another mounting board such that the signal electrode 25 and the antenna electrode 26 are connected to each other with the aid of a wiring pattern in the other mounting board. In addition, even with the resin sealing layer 3 disposed on the one principal surface 2*a* of the substrate 2, respective characteristics of the wireless functional section 4 and the antenna section 5 can be evaluated independently without employing the high-frequency connector or the like that has been used in the related art.

The wireless functional section 4 and the antenna section 5 may be connected to each other through, e.g., a matching circuit, a switching circuit, a filter circuit, or an attenuator, which are disposed on the other mounting board. In such a case, the matching circuit mounted to the substrate 2 can be omitted.

Antenna characteristics of the antenna formed by the antenna conductor 51 can be readily adjusted by a matching circuit or an attenuator, which is connected to the antenna conductor 51. Depending on situations, a degree of freedom in design of a device to which the antenna-integrated wireless module 1 is mounted can be increased because the wireless functional section 4 may be connected to the antenna disposed on the other mounting board instead of connecting the wireless functional section 4 and the antenna section 5 to each other.

The antenna characteristics of the antenna conductor 51 included in the antenna section 5 are interfered with objects, hands, etc., which are located around the antenna conductor 51 in all directions. Stated in another way, when a user operates a device, which includes the antenna-integrated wireless module 1 mounted thereto, in a state holding a casing of the device with a hand, there is a risk that the antenna characteristics and directivity of the antenna conductor 51 may vary under influences of the user's hand holding the casing of the device, and that a difficulty arises in maintaining stable communication quality.

In the embodiment described above, the shield layer 6 is further formed over lateral surfaces of the resin sealing layer 3, the lateral surfaces surrounding the antenna region 22. Accordingly, even when, for example, the hand approaches the antenna conductor 51 from the outside around the lateral surfaces of the antenna region 22, adverse influences upon the antenna characteristics and the antenna directivity can be suppressed to a minimum by the presence of the shield layer 6. Hence the antenna-integrated wireless module 1 having stable characteristics can be provided.

The conductive layer 61 is formed by the conductive paste that is filled into the grooves 31 and 33 formed in the groove forming step, or that is coated over the inner surfaces of the grooves 31 and 33. Accordingly, positions at which the shield layer 6 is formed, shapes of the formed shield layer 6, and so on can be optionally modified by adjusting positions at which the grooves 31 and 33 are formed, and respective depths of the grooves 31 and 33 from the upper surface of the resin sealing layer 3.

In more detail, as seen from FIG. 3C, by changing the positions and the depths of the grooves 33 formed in the resin sealing layer 3, which is coated over the entire one principal surface 2*a* of the array of the substrates 2, in surrounding relation to each region where the module 1 is formed, it is possible to optionally change the positions and the shapes of the shield layer 6 that is formed to extend from the upper surface to the outer lateral surfaces of the resin sealing layer 3. Furthermore, as seen from FIG. 3C, by changing the width and the depth of the groove 31 that is formed in the resin sealing layer 3 along the boundary between the wireless region 21 and the antenna region 22, it is possible to optionally change the position and the shape of the shield layer 6 that is formed in a region of the resin sealing layer 3, the region defining the boundary between the wireless region 21 and the antenna region 22.

Moreover, as seen from FIG. 3E, by adjusting an amount of the resin sealing layer 3 removed in the removing step on the side covering the antenna region 22, the thickness H1 of the resin sealing layer 3 on the side covering the antenna region 22 can be readily changed.

Thus, by manufacturing the antenna-integrated wireless modules 1 through the steps of forming the array of the modules 1 on an array of the substrates 2, and then dividing the array of the modules 1 into the individual modules, the modules 1 each including the shield layer 6, which is formed on the upper surface of the resin sealing layer 3 only on the side covering the wireless region 21, can be mass-produced with very high efficiency.

(Modifications)

Modifications of the antenna-integrated wireless module, which are constituted by modifying the configurations of the grooves 31 and 33 formed in the groove forming step, or by modifying the amount of the resin sealing layer 3 removed in the removing step on the side covering the antenna region 22, will be described below with reference to FIGS. 4 to 11. It is to be noted that modifications of the module constituted by modifying the groove forming step and the removing step are not limited to the modifications described below by way of example.

A. Modification (1)

Figure 4:
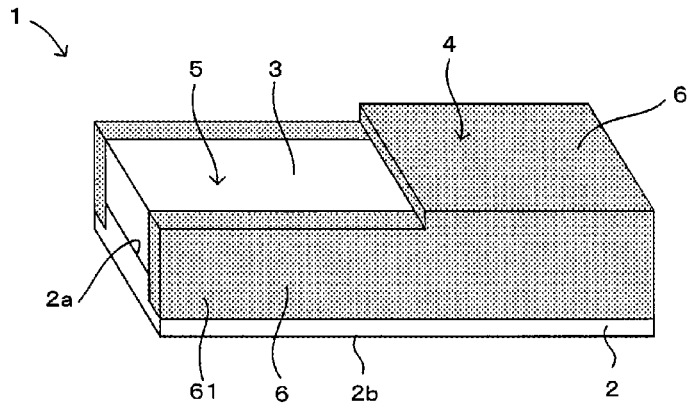
FIG. 4 is a perspective view illustrating a modification of the module of FIG. 1.
Figure 5:
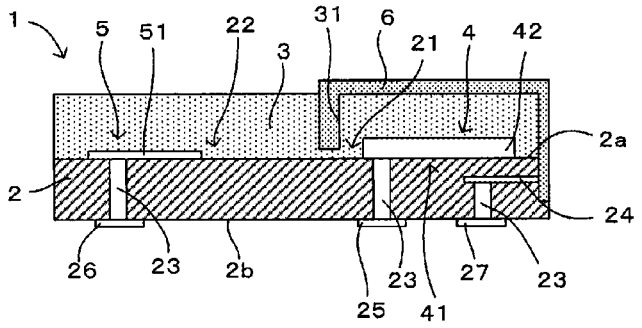
FIG. 5 is a sectional view of a module of FIG. 4.
Figure 6:
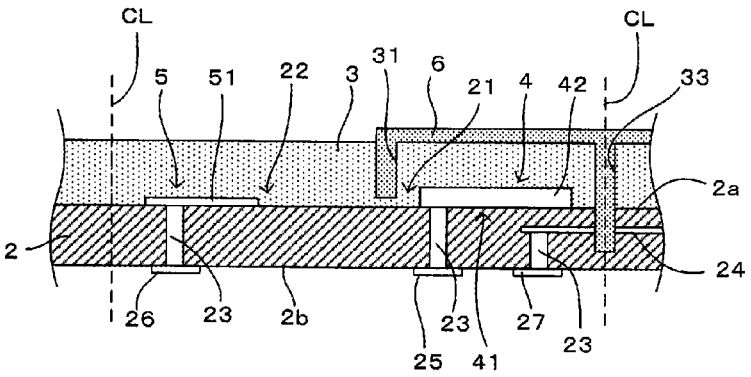
FIG. 6 illustrates one example of a method for manufacturing the module of FIG. 4.

FIG. 4 is a perspective view illustrating a modification of the module of FIG. 1, FIG. 5 is a sectional view of a module of FIG. 4, and FIG. 6 illustrates one example of a method for manufacturing the module of FIG. 4. This modification (1) is different from the first embodiment, described above with reference to FIG. 1, in that a portion of the resin sealing layer 3, the portion overlapping the antenna region 22, is not removed in the removing step, and that the resin sealing layer 3 has a uniform thickness. Furthermore, as illustrated in FIGS. 4 and 5, the groove 33 is not formed in the groove forming step at a position corresponding to an end surface of the module 1 on the side including the antenna section 5 (antenna region 22) in a lengthwise direction of the module 1. In the modification illustrated in FIGS. 4 to 6, therefore, the shield layer 6 is not formed on the module 1 at the position corresponding to the end surface thereof on the side including the antenna section 5 (antenna region 22) in the lengthwise direction of the module 1.

With the arrangement described above, since a time taken to remove a part of the resin sealing layer 3 in the removing step can be cut, it is possible to shorten a production time of the module 1, and to reduce a production cost of the module 1. Because the other structure is similar to that in the above embodiment, description of the other structure is omitted by assigning the same reference signs to the same components. As in the above first embodiment, the identification mark 7 may be formed in the upper surface of the resin sealing layer 3. It is to be noted that the identification mark 7 may be similarly formed in modifications and embodiments described later, but such a point is not repeated in the following description.

B. Modification (2)

Figure 7:
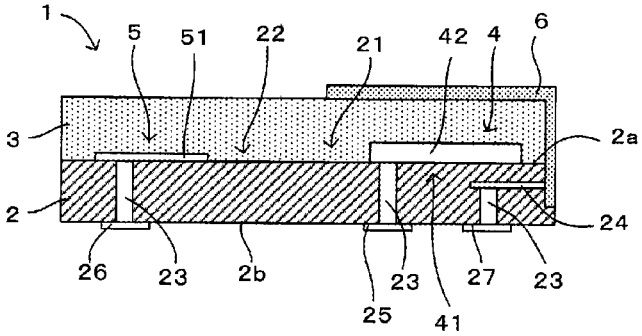
FIG. 7 is a sectional view illustrating a modification of the module of FIG. 1.
Figure 8:
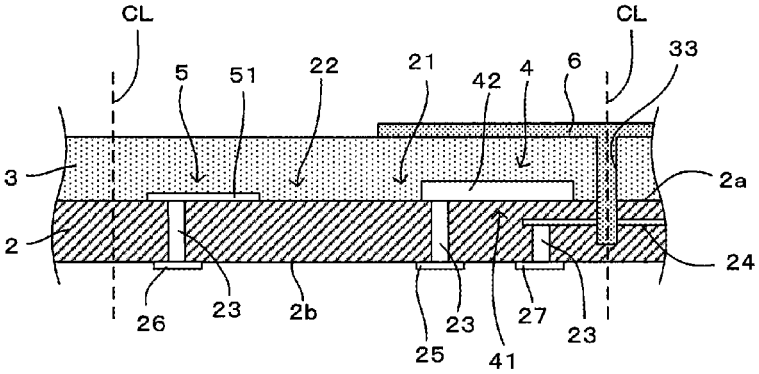
FIG. 8 illustrates one example of a method for manufacturing a module of FIG. 7.

FIG. 7 is a sectional view illustrating a modification of the module of FIG. 1, and FIG. 8 illustrates one example of a method for manufacturing a module of FIG. 7. This modification (2) is different from the modification (1), described above with reference to FIG. 4, in that, as illustrated in FIGS. 7 and 8, the groove 31 is not formed in the resin sealing layer 3 along the boundary between the wireless region 21 and the antenna region 22 in the groove forming step. Thus, in the modification illustrated in FIGS. 7 and 8, the shield layer 6 is not formed to extend over the boundary portion between the wireless region 21 and the antenna region 22 unlike the modification illustrated in FIGS. 4 to 6. Because the other structure is similar to that in the above embodiment, description of the other structure is omitted by assigning the same reference signs to the same components.

C. Modification (3)

Figure 9:
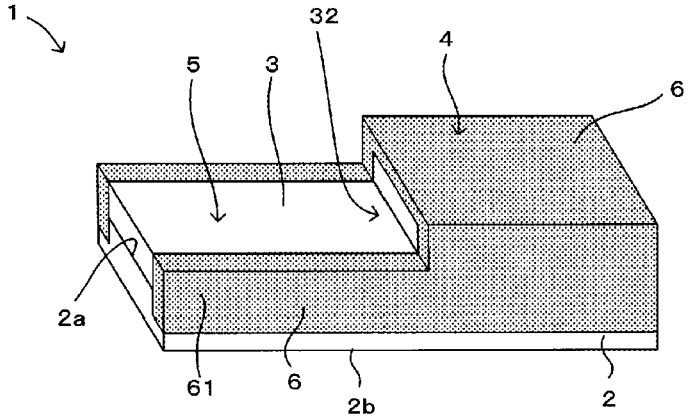
FIG. 9 is a perspective view illustrating a modification of the module of FIG. 1.
Figure 10:
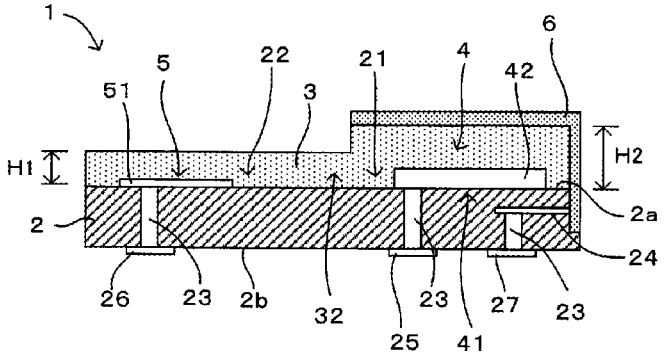
FIG. 10 is a sectional view of a module of FIG. 9.
Figure 11:
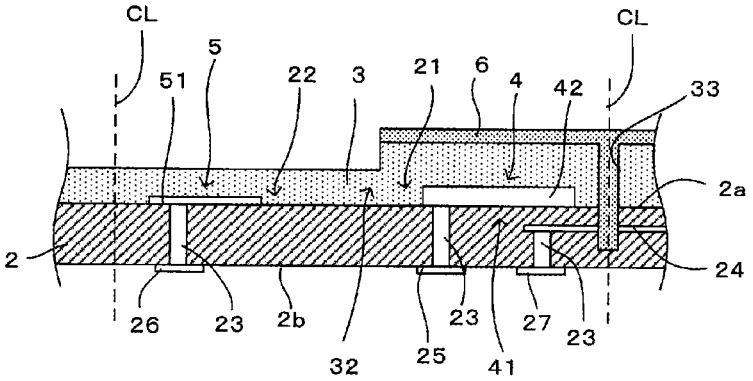
FIG. 11 illustrates one example of a method for manufacturing the module of FIG. 9.

FIG. 9 is a perspective view illustrating a modification of the module of FIG. 1, FIG. 10 is a sectional view of a module of FIG. 9, and FIG. 11 illustrates one example of a method for manufacturing the module of FIG. 9. This modification (3) is different from the modification (2), described above with reference to FIG. 7, in that, as illustrated in FIGS. 9 to 11, the thickness H1 of the resin sealing layer 3 in the region overlapping the antenna region 22 is thinner than the thickness H2 of the resin sealing layer 3 in the region overlapping the wireless region 21, and that a level difference step 32 is formed in the resin sealing layer 3 at the boundary between the wireless region 21 and the antenna region 22. Furthermore, in the modification illustrated in FIGS. 9 to 11, the shield layer 6 is formed to extend from the side including the wireless region 21 to the side including the antenna region 22 in a state entirely covering both the lateral surfaces of the module 1 in a widthwise direction thereof, as in the modification illustrated in FIGS. 7 and 8. Because the other structure is similar to that in the above embodiment, description of the other structure is omitted by assigning the same reference signs to the same components.

Second Embodiment

Figure 12:
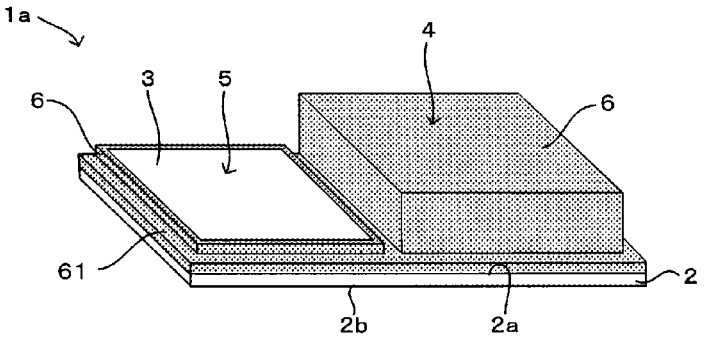
FIG. 12 is a perspective view of an antenna-integrated wireless module according to a second embodiment of the present invention.

A second embodiment of the present disclosure will be described below with reference to FIGS. 12 and 13. FIG. 12 is a perspective view of an antenna-integrated wireless module according to a second embodiment of the present invention, and FIGS. 13A to 13D illustrate different states in one example of a method for manufacturing the module of FIG. 12.

Figure 13A:
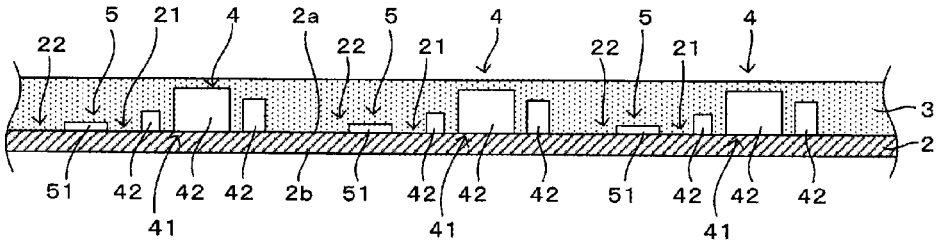
FIGS. 13A to 13D illustrate different states in one example of a method for manufacturing the module of FIG. 12.
Figure 13B:
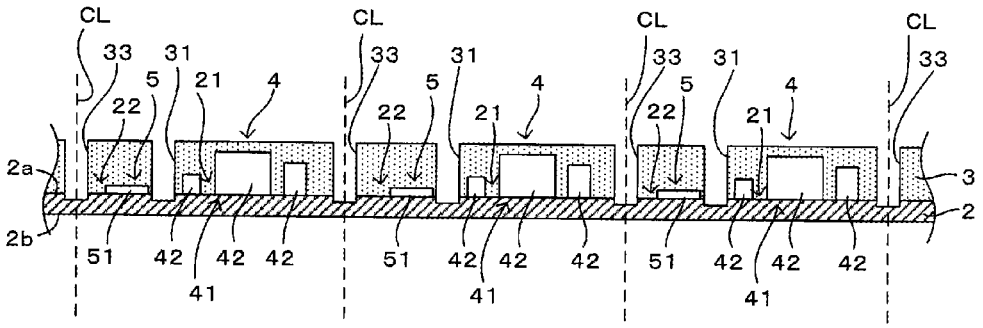
Figure 13C:
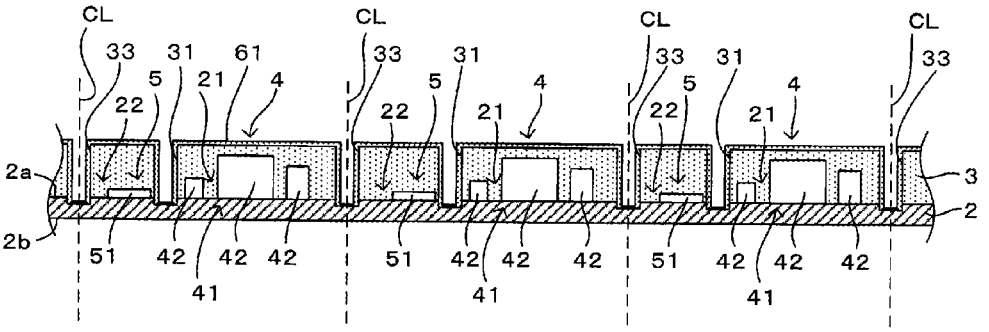
Figure 13D:
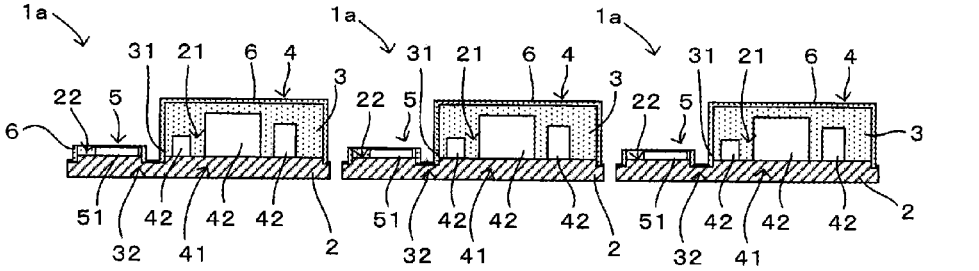

A module 1*a* according to the second embodiment is different from the module 1 according to the above first embodiment in that, as illustrated in FIGS. 12, 13C and 13D, the conductive layer 61 is formed over the inner surfaces of the grooves 31 and 33 in the conductive layer forming step instead of filling the conductive paste into the grooves 31 and 33. Furthermore, in the groove forming step, the groove 31 is formed in a depth larger than the thickness of the resin sealing layer 3. The conductive layer 61 may be formed over the inner surfaces of the grooves 31 and 33 by a general thin-film forming technique, e.g., sputtering or plating. Because the other structure is similar to that in the above first embodiment, description of the other structure is omitted by assigning the same reference signs to the same components.

The module 1*a* according to the second embodiment is manufactured in a similar manner to that for the module 1 according to the above first embodiment as described below.

First, as illustrated in FIG. 13A, an array of the substrates 2 is prepared each of which includes the wireless functional section 4 disposed in a region overlapping the wireless region 21 when looked at in the plan view, and the antenna region 22 disposed in a region overlapping the antenna section 5 when looked at in the plan view (preparation step). Next, as illustrated in FIG. 13B, the resin sealing layer 3 is formed so as to cover the wireless region 21 and the antenna region 22, including the wireless functional section 4 disposed in the wireless region 21 and the antenna section 5 disposed in the antenna region 22 (sealing step). Next, the grooves 31 and 33 are formed in the resin sealing layer 3 by employing a general device, e.g., a dicer (groove forming step).

Next, as illustrated in FIG. 3C, the conductive layer 61 covering the surface of the resin sealing layer 3, including the inner surfaces of the grooves 31 and 33, is formed by coating a conductive paste (conductive material) (conductive layer forming step). Next, as illustrated in FIG. 3D, the conductive material in a region of the conductive layer 61 formed on the upper surface of the resin sealing layer 3, the region overlapping the antenna region 22 when looked at in the plan view, is removed (removing step). As a result, the shield layer 6 is formed by the conductive layer 61 on the upper surface of the resin sealing layer 3 only in the region overlapping the wireless region 21 when looked at in the plan view.

In this embodiment, as illustrated in FIG. 12, the shield layer 6 is further formed over all the lateral surfaces of the resin sealing layer 3 surrounding the antenna region 22 as in the above first embodiment.

Moreover, in the removing step, a part of the resin sealing layer 3 in the region overlapping the antenna region 22 is removed together with the conductive material such that the thickness of the resin sealing layer 3 in the region overlapping the antenna region 22 is thinner than the thickness of the resin sealing layer 3 in the region overlapping the wireless region 21. Accordingly, the level difference step 32 is formed in the resin sealing layer 3 at the boundary between the wireless region 21 and the antenna region 22. The marking step of forming the predetermined identification mark 7 in a region of the upper surface of the resin sealing layer 3 on the substrate 2, the region overlapping the antenna region 22 when looked at in the plan view, may be executed after the removing step.

Finally, as illustrated in FIG. 3D, the array of the substrates 2 is divided along the cut lines CL into the individual substrates, whereby the modules 1*a* are completed.

The second embodiment can also provide similar advantageous effects to those obtained with the above first embodiment.

D. Modification (4)

Figure 14:
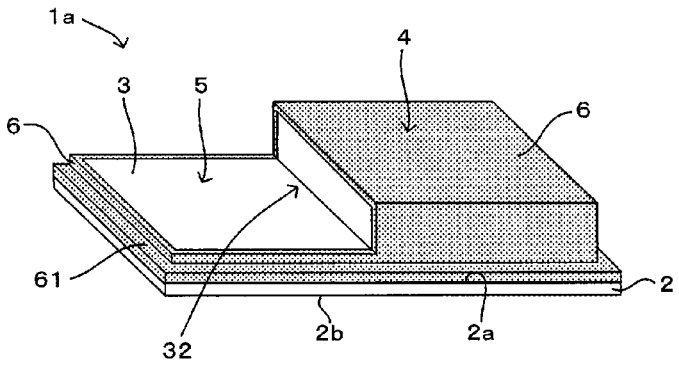
FIG. 14 is a perspective view illustrating a modification of the module of FIG. 12.

FIG. 14 is a perspective view illustrating a modification of the module of FIG. 12. This modification (4) is different from the second embodiment, described above with reference to FIG. 12, in that the groove 31 is not formed in the groove forming step as in the modification (3) described above with reference to FIG. 9. Thus, in the modification illustrated in FIG. 14, the shield layer 6 is not formed in the resin sealing layer 3 at the boundary between the wireless region 21 and the antenna region 22. Because the other structure is similar to that in the above embodiment, description of the other structure is omitted by assigning the same reference signs to the same components.

Third Embodiment

Figure 15:
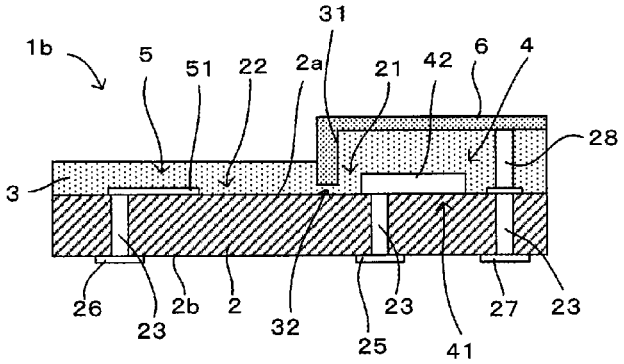
FIG. 15 is a sectional view of an antenna-integrated wireless module according to a third embodiment of the present invention.

A third embodiment of the present disclosure will be described below with reference to FIG. 15. FIG. 15 is a sectional view of an antenna-integrated wireless module according to the third embodiment of the present invention.

A module 1*b* according to the third embodiment is different from the module 1 according to the first embodiment, described above with reference to FIG. 1, in a method of connecting the shield layer 6 and the ground electrode 27. Furthermore, the shield layer 6 is not formed on a lateral surface of the module 1*b* on the side including the antenna region 22 in a lengthwise direction of the module 1*b*. Because the other structure is similar to that in the above first embodiment, description of the other structure is omitted by assigning the same reference signs to the same components.

As illustrated in FIG. 15, an electrode post 28 is disposed in the wireless region 21 by burying an electrode pin into the resin sealing layer 3. The ground electrode 27 is connected to the shield layer 6 through the via conductor 23 and the electrode post 28. The ground electrode 27 may be connected to the shield layer 6 through, instead of the electrode post 28, a via conductor that is formed by filling the conductive paste into a via (via hole) bored to penetrate the resin sealing layer 3.

The third embodiment can also provide similar advantageous effects to those obtained with the above first embodiment. It is to be noted that, in the module 1*b* illustrated in FIG. 15, the groove 31 is not always required to be formed in the resin sealing layer 3, and the shield layer 6 is not always required to be disposed at the boundary between the wireless region 21 and the antenna region 22.

Fourth Embodiment

Figure 16:
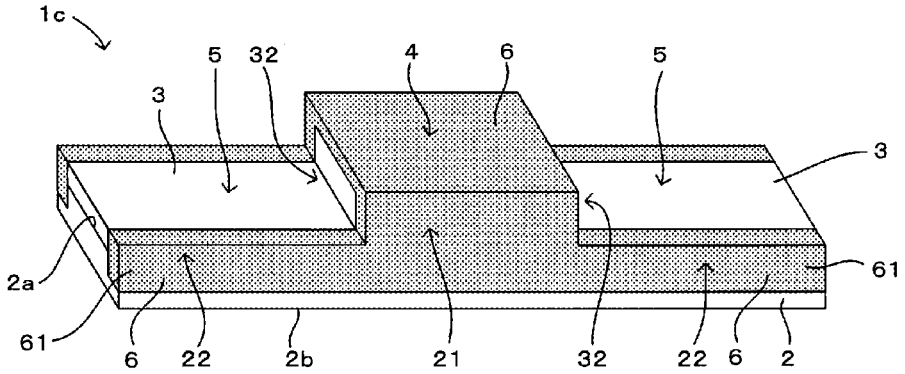
FIG. 16 is a perspective view of an antenna-integrated wireless module according to a fourth embodiment of the present invention.

A fourth embodiment of the present disclosure will be described below with reference to FIG. 16. FIG. 16 is a perspective view of an antenna-integrated wireless module according to the fourth embodiment of the present invention.

A module 1*c* according to the fourth embodiment is different from the module 1 according to the first embodiment, described above with reference to FIG. 1, in that, as illustrated in FIG. 16, a plurality of antenna regions 22 is disposed in the one principal surface 2*a* of the substrate 2 in a sandwiching relation to the wireless region 21. Furthermore, the antenna conductor 51 (not illustrated) is disposed at least on the one principal surface 2*a* of the substrate 2 or inside the substrate 2 in a region overlapping each of the antenna regions 22 when looked at in the plan view. Moreover, in the embodiment illustrated in FIG. 16, the shield layer 6 is formed to extend from the side including the wireless region 21 to the side including the antenna region 22 in a state entirely covering both lateral surfaces of the module 1*c* in a widthwise direction thereof. Because the other structure is similar to that in the above first embodiment, description of the other structure is omitted by assigning the same reference signs to the same components.

The fourth embodiment can provide not only similar advantageous effects to those obtained with the above first embodiment, but also the following advantageous effects. The antenna-integrated wireless module 1*c* can be provided in a form adaptable for communication with diversity or carrier aggregation by employing the plurality of antennas formed by the antenna conductors 51 each of which is disposed in the region overlapping the antenna region 22 when looked at in the plan view. Moreover, the antenna-integrated wireless module 1*c* can be provided in a form adaptable for multiband or multimode communication by setting the antennas in correspondence to predetermined communication methods and predetermined frequency bands.

Fifth Embodiment

Figure 17:
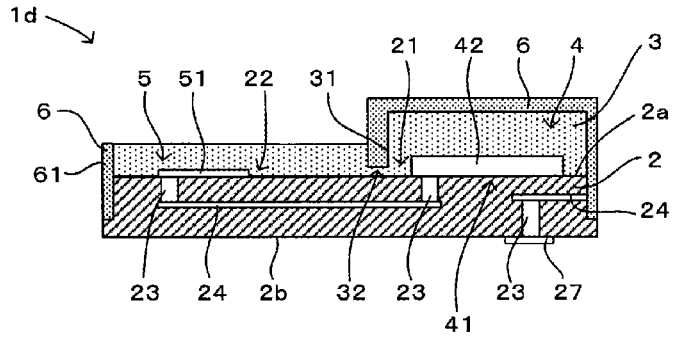
FIG. 17 is a sectional view of an antenna-integrated wireless module according to a fifth embodiment of the present invention.

A fifth embodiment of the present disclosure will be described below with reference to FIG. 17. FIG. 17 is a sectional view of an antenna-integrated wireless module according to the fifth embodiment of the present invention.

A module 1*d* according to the fifth embodiment is different from the module 1 according to the first embodiment, described above with reference to FIG. 1, in that, as illustrated in FIG. 17, the wireless functional section 4 and the antenna conductor 51 are connected to each other through a wiring pattern formed by the via conductors 23 and the electrode pattern 24, which are disposed on the one principal surface 2*a* of the substrate 2 or inside the substrate 2. Because the other structure is similar to that in the above first embodiment, description of the other structure is omitted by assigning the same reference signs to the same components.

The fifth embodiment can also provide the advantageous effect that electromagnetic waves radiated from the wireless functional section 4 including the RF circuit 41 can be suppressed by the shield layer 6 formed on the upper surface of the resin sealing layer 3 on the side covering the wireless region 21, as in the above first embodiment.

Sixth Embodiment

Figure 18:
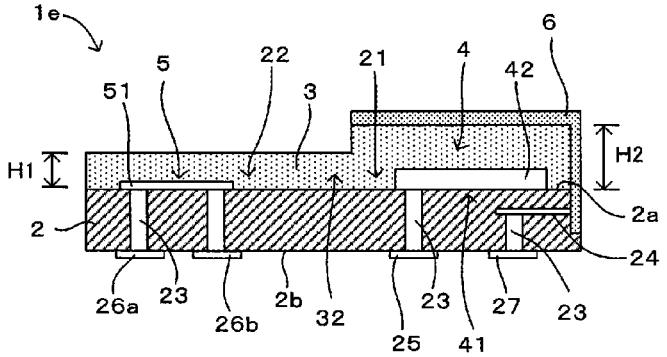
FIG. 18 is a sectional view of an antenna-integrated wireless module according to a sixth embodiment of the present invention.

A sixth embodiment of the present disclosure will be described below with reference to FIG. 18. FIG. 18 is a sectional view of an antenna-integrated wireless module according to the sixth embodiment of the present invention.

A module 1*e* according to the sixth embodiment is most greatly different from the module 1 according to the first embodiment, described above with reference to FIG. 1, in that, as illustrated in FIG. 18, the antenna electrode connected to the antenna section 5 includes a one-end antenna electrode 26*a* connected to one end of the antenna conductor 51, and an opposite-end antenna electrode 26*b* connected to an opposite end of the antenna conductor 51. Furthermore, in this embodiment, the shield layer 6 is formed, though not illustrated, to entirely cover both lateral surfaces of the module 1*e* in a widthwise direction thereof (i.e., lateral surfaces thereof on the backside and the front side when looking at FIG. 18 from a direction facing the drawing sheet) in a state extending from the side including the wireless region 21 to the side including the antenna region 22. Because the other structure is similar to that in the above first embodiment, description of the other structure is omitted by assigning the same reference signs to the same components.

Generally, an antenna is designed in a configuration opened at one end in many cases. It is, therefore, generally possible to measure an input impedance of the antenna when viewed from, e.g., a connector terminal for use in measurement. However, it has been difficult to check the state of an antenna conductor, such as bandpass characteristics of the antenna, by determining, e.g., a path loss of the antenna.

According to this embodiment, bandpass characteristics of a transfer line formed by the antenna conductor 51, which have been impossible to evaluate in antennas of related art, can be checked by utilizing the one-end antenna electrode connected to the one end of the antenna conductor 51 and the opposite-end antenna electrode connected to the opposite end of the antenna conductor 51. As a result, manufacturing accuracy of the antenna section 5 can be readily determined on the basis of the measured bandpass characteristics of the antenna conductor 51 at the time of product shipment, for example.

<Others>

While, as described in the above embodiments, the resin sealing layer 3 and the shield layer 6 can be formed in various configurations, the above embodiments may be further modified as illustrated in FIGS. 19 to 24. FIGS. 19 to 24 illustrate modifications of the antenna-integrated wireless module. It is to be noted that the following description is made mainly about points different from the above embodiments, and that description of the other structure is omitted by assigning the same reference signs to the same components.

Figure 19:
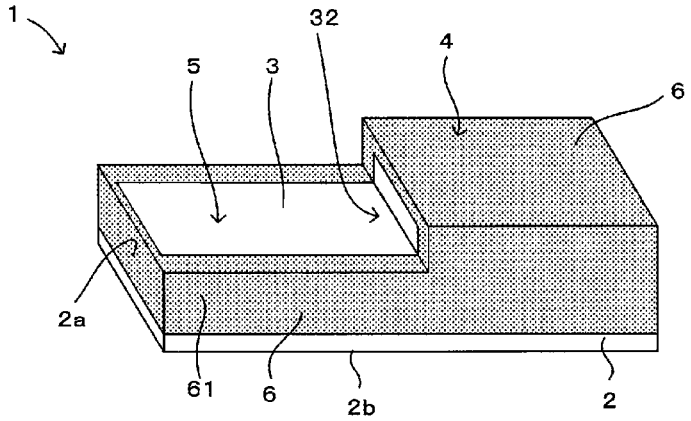
FIG. 19 illustrates a modification of the antenna-integrated wireless module.

The module 1 illustrated in FIG. 19 is different from the module illustrated in FIG. 1 in that the shield layer 6 is not formed on the resin sealing layer 3 at the boundary between the wireless region 21 and the antenna region 22.

Figure 20:
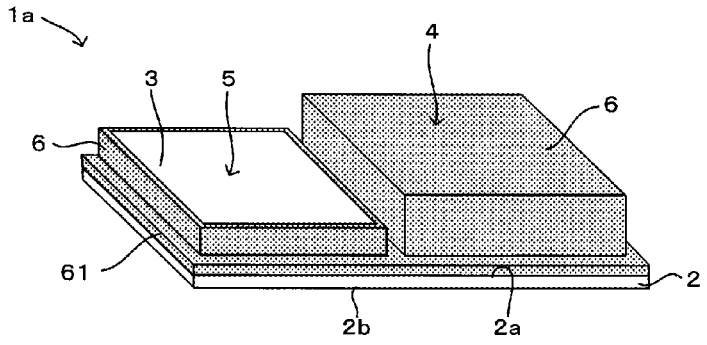
FIG. 20 illustrates a modification of the antenna-integrated wireless module.
Figure 21:
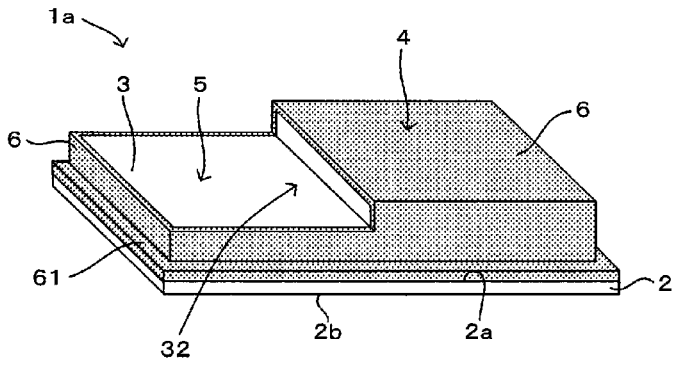
FIG. 21 illustrates a modification of the antenna-integrated wireless module.

The modules 1*a* illustrated in FIGS. 20 and 21 are different respectively from the modules illustrated in FIGS. 12 and 14 in that the resin sealing layer 3 on the side covering the antenna region 22 is formed in a smaller thickness.

Figure 22:
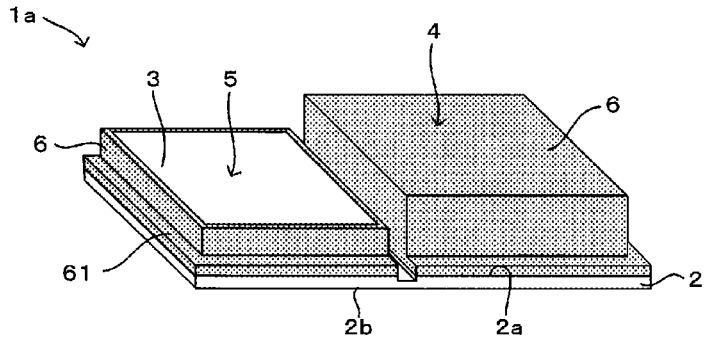
FIG. 22 illustrates a modification of the antenna-integrated wireless module.

The module 1*a* illustrated in FIG. 22 is different from the module illustrated in FIG. 20 in that, when the individual modules 1*a* are obtained by cutting, the conductive layer 61 and the substrate 2 at the boundary between the wireless region 21 and the antenna region 22 are also cut such that the shield layer 6 on the side covering the wireless region 21 and the shield layer 6 on the side covering the antenna region 22 are electrically insulated from each other. Likewise, in any of the above embodiments, the shield layer 6 on the side covering the wireless region 21 and the shield layer 6 on the side covering the antenna region 22 may be electrically insulated from each other by removing a part of the shield layer 6.

Figure 23:
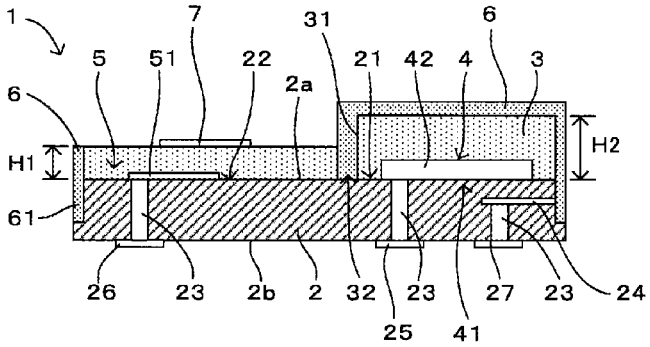
FIG. 23 illustrates a modification of the antenna-integrated wireless module.
Figure 24:
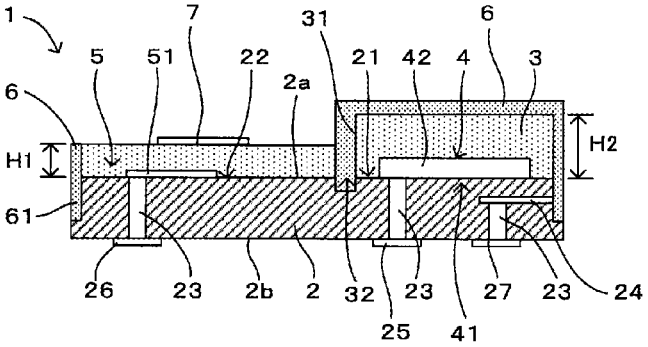
FIG. 24 illustrates a modification of the antenna-integrated wireless module.

The module 1 illustrated in FIG. 23 is different from the module illustrated in FIG. 1 in that the groove 31 is formed at a depth reaching the one principal surface 2*a* of the substrate 2. The module 1 illustrated in FIG. 24 is different from the module illustrated in FIG. 1 in that, in the groove forming step, the groove 31 is formed by cutting the substrate 2 together with the resin sealing layer 3. Thus, in the module illustrated in FIG. 24, the shield layer 6 is formed to extend into the inside of the substrate 2.

With the configurations illustrated in FIGS. 23 and 24, when a wireless functional component, e.g. the RF circuit 41, generating electromagnetic waves is mounted to the substrate 2 and when the antenna conductor 51 is formed on the substrate 2, the wireless functional section 4 and the antenna section 5 are brought into a state partitioned with the shield layer 6 interposed therebetween, by forming the groove 31 at a depth that is equal to or larger than the thickness of the resin sealing layer 3, and by forming the shield layer 6 so as to cover the inner surface of the groove 31 as well. Accordingly, the electromagnetic waves radiated from the wireless functional component, e.g., the RF circuit 41, can be suppressed from coming into the antenna section 5, and the electromagnetic waves radiated from the wireless functional component can be suppressed from adversely affecting the antenna section 5. Also in any of the above embodiments, the groove 31 may be formed as in the modifications illustrated in FIGS. 23 and 24.

It is to be noted that the present disclosure is not limited to the above embodiments, and that the present disclosure can be variously modified into other embodiments than the above-described ones within the scope not departing from the gist of the invention. For example, while, in the above embodiments, each antenna-integrated wireless module is manufactured by integrally forming a plurality of antenna-integrated wireless modules together by employing an array of the substrates 2, and then dividing the plurality of antenna-integrated wireless modules into individual pieces, the individual antenna-integrated wireless modules may be manufactured separately.

While, in the above embodiments, isolation characteristics between the wireless functional section 4 and the antenna section 5 are improved with the arrangement that the wireless functional section 4 is disposed in the region overlapping the wireless region 21 when looked at in the plan view and the antenna section 5 is disposed in the region overlapping the antenna region 22 when looked at in the plan view, the antenna section 5 may further include a matching circuit that is connected to the feeding point of the antenna conductor 51.

Furthermore, the antenna-integrated wireless module may be constituted, by way of example, as follows. The wireless functional section 4 including the RF circuit 41 and the antenna section 5 including the antenna conductor 51 may be disposed on both the sides spaced from each other in the lengthwise direction of the antenna-integrated wireless module, and a switch IC and a filter circuit, e.g., a SAW filter, may be disposed in a transfer path formed in the boundary portion between the wireless region 21 and the antenna region 22.

Moreover, the conductive material forming the shield layer and the antenna conductor is not limited to the above-mentioned examples, and various materials, which are ordinarily employed in the art, may be used optionally.

When any of the antenna-integrated wireless modules described above is used in a state mounted to, e.g., another mounting board, the antenna-integrated wireless module mounted to the other mounting board may be sealed with resin on the other mounting board.

The shield layer 6 is just needed to be formed in a region of the upper surface of the resin sealing layer 3, the region overlapping the wireless region 21 when looked at in the plan view.

The present disclosure can be widely applied to the antenna-integrated wireless module including the wireless functional section provided with the RF circuit, and the antenna section provided with the antenna conductor, and to the method for manufacturing the antenna-integrated wireless module.

1, 1*a*, 1*b*, 1*c*, 1*d*, 1*e* antenna-integrated wireless modules
2 substrate
2*a* one principal surface
21 wireless region
22 antenna region
25 signal electrode
26 antenna electrode
26*a* one-end antenna electrode
26*b* opposite-end antenna electrode
3 resin sealing layer
31 groove
32 level difference step
4 wireless functional section
41 RF circuit
5 antenna section
51 antenna conductor
6 shield layer
61 conductive layer
7 identification mark
H1 thickness

The invention claimed is:

1. An antenna-integrated wireless module comprising:

a substrate having a first surface, the substrate including a wireless region and an antenna region;

a wireless functional section disposed in the wireless region and including an RF circuit disposed at least on the first surface of the substrate or inside the substrate;

an antenna section disposed in the antenna region and including an antenna conductor; and a resin sealing layer disposed so as to cover at least a part of the first surface of the substrate, wherein a thickness of the resin sealing layer in a portion overlapping the antenna region in a plan view is thinner than a thickness of the resin sealing layer in a portion overlapping the wireless region in the plan view, such that the resin sealing layer has a step at a location between the wireless region and the antenna region.

2. The antenna-integrated wireless module according to claim 1, wherein the wireless functional section and the antenna section are not directly connected on the first surface of the substrate.

3. The antenna-integrated wireless module according to claim 1, further comprising a shield layer disposed on an upper surface of the resin sealing layer so as not to overlap the antenna region in the plan view.

4. The antenna-integrated wireless module according to claim 3, wherein the shield layer is on the upper surface of the resin sealing layer only in a region overlapping the wireless region in the plan view.

5. The antenna-integrated wireless module according to claim 3, wherein the shield layer covers at least a part of the step of the resin sealing layer.

6. The antenna-integrated wireless module according to claim 5, further comprising a groove in the step of the resin sealing layer that extends toward the first surface of the substrate, wherein the shield layer extends over an inner surface of the groove.

7. The antenna-integrated wireless module according to claim 3, wherein the shield layer extends over lateral surfaces of the resin sealing layer, the lateral surfaces surrounding at least a part of the wireless region or the antenna region.

8. The antenna-integrated wireless module according to claim 1, wherein the plurality of antenna regions are disposed in the substrate in a sandwiching relation to the wireless region, and the antenna conductor is disposed in each of the antenna regions at least on the first surface of the substrate or inside the substrate.

9. The antenna-integrated wireless module according to claim 1, wherein the wireless functional section and the antenna section are connected via a conductor inside the substrate.

10. The antenna-integrated wireless module according to claim 1, wherein the antenna electrode includes a one-end antenna electrode connected to one end of the antenna conductor, and an opposite-end antenna electrode connected to an opposite end of the antenna conductor.

11. An antenna-integrated wireless module comprising:

a substrate having a first surface, the substrate including a wireless region and an antenna region;

a wireless functional section disposed in the wireless region and including an RF circuit disposed at least on the first surface of the substrate or inside the substrate;

an antenna section disposed in the antenna region and including an antenna conductor; and a resin sealing layer disposed so as to cover at least a part of the first surface of the substrate, wherein the substrate has a step at a boundary between the wireless region and the antenna region, and wherein the resin sealing layer does not the cover the step of the substrate.

12. The antenna-integrated wireless module according to claim 11, wherein the wireless functional section and the antenna section are not directly connected on the first surface of the substrate.

13. The antenna-integrated wireless module according to claim 11, further comprising a shield layer disposed on an upper surface of the resin sealing layer so as not to overlap the antenna region in a plan view.

14. The antenna-integrated wireless module according to claim 13, wherein the shield layer is on the upper surface of the resin sealing layer only in a region overlapping the wireless region in the plan view.

15. The antenna-integrated wireless module according to claim 13, wherein the shield layer covers at least a part of the step of the substrate.

16. The antenna-integrated wireless module according to claim 13, wherein the shield layer extends over lateral surfaces of the resin sealing layer, the lateral surfaces surrounding at least a part of the wireless region or the antenna region.

17. The antenna-integrated wireless module according to claim 11, wherein a thickness of the resin sealing layer in a portion overlapping the antenna region in a plan view is thinner than a thickness of the resin sealing layer in a portion overlapping the wireless region in the plan view.

18. The antenna-integrated wireless module according to claim 11, wherein the plurality of antenna regions are disposed in the substrate in a sandwiching relation to the wireless region, and the antenna conductor is disposed in each of the antenna regions at least on the first surface of the substrate or inside the substrate.

19. The antenna-integrated wireless module according to claim 11, wherein the wireless functional section and the antenna section are connected via a conductor inside the substrate.

20. The antenna-integrated wireless module according to claim 11, wherein the antenna electrode includes a one-end antenna electrode connected to one end of the antenna conductor, and an opposite-end antenna electrode connected to an opposite end of the antenna conductor.

* * * * *